US009370870B2

(12) United States Patent
Jakob

(10) Patent No.: US 9,370,870 B2
(45) Date of Patent: Jun. 21, 2016

(54) RAISING APPARATUS

(71) Applicant: Joachim Jakob, Radolfzell (DE)

(72) Inventor: Joachim Jakob, Radolfzell (DE)

( * ) Notice: Subject to any disclaimer, the term of this patent is extended or adjusted under 35 U.S.C. 154(b) by 0 days.

(21) Appl. No.: 14/942,191

(22) Filed: Nov. 16, 2015

(65) Prior Publication Data

US 2016/0067876 A1 Mar. 10, 2016

Related U.S. Application Data

(63) Continuation of application No. 13/810,863, filed as application No. PCT/EP2011/003575 on Jul. 18, 2011.

(30) Foreign Application Priority Data

Jul. 19, 2010 (DE) ..... 10 2010 036 476

(51) Int. Cl.
*B26D 7/18* (2006.01)
*B26F 1/14* (2006.01)

(52) U.S. Cl.
CPC ..... *B26D 7/1818* (2013.01); *B26F 1/14* (2013.01)

(58) Field of Classification Search
CPC ..... B26D 7/18; B26D 7/1818; B26F 1/14
USPC ..... 83/112, 119, 123, 129, 109, 117
See application file for complete search history.

(56) References Cited

U.S. PATENT DOCUMENTS 1,976,702 A * 10/1934 Trott ..... B60K 5/1216 248/604
3,439,848 A * 4/1969 Schwarzkopf ..... B26D 7/1836 225/96
3,556,503 A * 1/1971 van Moss, Jr. ..... B61F 5/142 267/153
3,596,677 A * 8/1971 Clark ..... F15B 13/0417 137/501
3,735,653 A * 5/1973 Powell ..... B21D 28/145 83/108
3,946,627 A * 3/1976 Hofmann ..... B26D 7/1818 493/342
5,280,890 A * 1/1994 Wydra ..... F16F 1/373 267/136
5,531,007 A * 7/1996 Labounty ..... B23D 17/00 241/101.73
5,546,839 A * 8/1996 Gardiner ..... B26D 5/12 83/123
5,906,363 A * 5/1999 Reis ..... B25B 11/005 269/21
8,783,148 B2 * 7/2014 Weibelt ..... B26D 7/1818 493/373
8,899,393 B2 * 12/2014 Kraner ..... G05B 19/404 188/266.7
2007/0176341 A1 * 8/2007 Molitor ..... B60G 11/22 267/292
2008/0066595 A1 3/2008 Coursey et al.
2010/0107846 A1 * 5/2010 Lee ..... B21D 28/34 83/686
2013/0068077 A1 * 3/2013 Coursey ..... F16F 1/18 83/112

(Continued)

FOREIGN PATENT DOCUMENTS

DE 26 15 919 10/1977
DE 10 2010 036 476 4/2011
WO WO 2012/019692 2/2012

OTHER PUBLICATIONS

International Search Report for corresponding International Application No. PCT/EP2011/003575 mailed Nov. 22, 2011.

(Continued)

*Primary Examiner* — Sean Michalski
(74) *Attorney, Agent, or Firm* — Womble Carlyle Sandridge & Rice, LLP

(57) ABSTRACT

The invention concerns a raising apparatus for lifting sheets of material in tools, in particular punching and stripping tools, with a first spring element which possesses a first spring rate, and a second spring element which possesses a second spring rate.

18 Claims, 3 Drawing Sheets

(56) References Cited

U.S. PATENT DOCUMENTS

| | | | | |
|---|---|---|---|---|
| 2013/0112053 | A1 | 5/2013 | Jakob | |
| 2015/0000485 | A1 * | 1/2015 | Piro | B26F 1/02 83/30 |

OTHER PUBLICATIONS

International Preliminary Report on Patentability for corresponding International Application No. PCT/EP2011/003575 issued Jan. 22, 2013.

http://mimas.physics.drexel.edu/Physics101/PHYS101LAB-03.pdf. date Jun. 15, 2010 (archive.org). Example of springs of different rates coupled to a "block" commensurate in scope with claims 1 and 11.

* cited by examiner

RAISING APPARATUS

CROSS-REFERENCE

The present application is a continuation of U.S. patent application Ser. No. 13/810,863, filed Jan. 17, 2013, which is a national phase entry under 35 U.S.C. §371 of International Application PCT/EP2011/003575, filed Jul. 18, 2011, which claims priority to German Patent Application No. 102010036476.2, filed Jul. 19, 2010. The entire disclosures of the above-referenced patent applications are incorporated herein by reference.

TECHNICAL FIELD

The present invention generally concerns a raising apparatus for being in a holding slot of a tool, for lifting punching parts or sheets of material, wherein the raising apparatus has a spring element.

BACKGROUND

When working on paper-based products e.g. paper, cardboard or cartons, raw sheets of material are typically used over tools like presses, punches or stripping tools. It is especially important when punching and stripping that parts punched or stripped from a sheet are reliably and quickly removed, since they will otherwise lead to problems with further processing stages. For example, cardboard elements punched out and not removed can lead to stoppages in the following processing machines. Besides that, it is important in the case of such applications that the sheets of material from which parts are punched or stripped are reliably transported further and do not become entangled in the tools. When removing entangled or jammed punching parts or sheets of material from machine tools, valuable time and work expenditure is wasted and unnecessary costs are incurred.

As an example of the state of the art, US 2008/0066595 A1 describes a bendable raising apparatus for lifting punching or stripping parts or sheets of material. The fact that simply a spring element with an unchanging spring rate is provided to lift the punching or stripping parts or sheets of material is, however, a problem in the raising apparatus described. Due to the single spring rate, it can happen that stripping or punching parts or sheets of material are lifted too quickly or too vigorously or too unreliably or too slowly, depending upon which materials or raw materials are being used.

SUMMARY

It is a task of the present invention to rectify the disadvantages in the abovementioned state of the art, or at least to reduce them. It is in particular a task of the present invention to create a raising apparatus to lift punching parts or stripping parts or sheets of material which is adapted to lift punching or stripping parts or sheets of material from different raw materials reliably and quickly.

An aspect of the present invention is the provision of a raising apparatus for being in a holding slot of a tool, for lifting one or more punching parts and/or sheets of material, wherein the raising apparatus has first and second spring elements with different spring rates. Another aspect of the present invention is a method of using the raising apparatus.

In comparison with the state of the art, the invention has the advantage that, with the availability of a second spring element, a great degree of flexibility is achieved, whereby punching or stripping parts or sheets of material from different materials can be lifted quickly and reliably.

It is an intention of the present invention to have a raising apparatus to lift punching or stripping parts or sheets of material or materials, whereby the raising apparatus is usable in a holding slot of a tool, preferably a stripping tool or a punching tool. In doing so, the raising apparatus includes a first spring element with a first spring rate, as well as a second spring element with a different spring rate from the first spring element. The raising apparatus is particularly suitable for lifting cardboard punching parts, carton punching parts, paper punching parts, plastic punching parts or metal punching parts or stripping parts or sheets of material made of cardboard, carton, paper, plastic or metal.

A beneficial way to have the raising apparatus is with a stop block. This stop block is typically usable manually in the tool's holding slot. The stop block is typically cuboid or has at least one curve. The advantage of such a stop block lies in the fact that, with the help of this stop block, the raising apparatus is positioned precisely and held firmly in the holding slot.

A beneficial way to have the raising apparatus is with the spring rates of the first spring element being larger or smaller than the spring rates of the second spring element. The preferred mode for carrying out the invention is with the spring rate of the first spring element at 50% to 100%, preferably 60% to 400%, larger than the spring rate of the second spring element. It is preferable that in the invention the spring rate of the first spring element is 70% to 300% larger than the spring rates of the second spring element. With the particularly beneficial way to have the raising apparatus, the different spring rates of the first spring element and the second spring element result from the spring elements being different from one another in shape, size or material.

For typical modes of carrying out the invention, the raising apparatus includes at least a further spring element with a further spring rate, which differs from the spring rate of the other spring element or the spring rate of the second spring element. The beneficial way to have the invention is where a spring rate is at least not fixed in advance, but is freely applicable with the help of an adjusting device. The spring rate is set preferably continuously or in stages. The advantage of a raising apparatus with more than one spring element, wherein the different spring elements have different spring rates, lies in the fact that a greater flexibility is achieved with regard to processing different materials.

A beneficial way to have the invention is to have the raising apparatus made from metal or plastic. Typical raising apparatuses are made from metal and plastic according to the invention.

A beneficial way to have the invention is to have the first spring element or the second spring element of the raising apparatus in each case include a label to easily differentiate between the two spring elements. It is advantageous to have labelling on at least one spring element to easily differentiate a geometric form or to have a colored label on at least one spring element. Such labelling offers the advantage that a user, when using the raising apparatus, can quickly and easily recognize which operating position shall be used, so which spring element is on top, when applying the raising apparatus in the stripping tool, and which spring rate takes effect on the workpiece or the punching parts or the stripping parts.

A beneficial way to have the invention is to have the raising apparatus include at least one shape in the place where the spring elements meet the stop block. This shape typically leads to improved mechanical stability of the connection between the stop block and the spring elements. An advantage of such a shape lies in the fact that breaking off or bending the raising apparatus in the area where the stop block and spring elements meet is prevented.

A beneficial way to have the invention is to have the thickness of a raising apparatus stop block greater than the width of a holding slot of the stripping tool. A width of the first spring element and a width of the second spring element is typically smaller than the width of the holding slot, so that the first spring element and the second spring element are extendable in the holding slot. The holding slot typically includes a holding socket, wherein the thickness of the stop block is smaller than the width of the holding socket, so that the stop block can be inserted in the holding socket. Due to the fact that the stop block cannot be inserted in each position in the holding slot, but simply in the holding socket of the holding slot, it is guaranteed that the raising apparatus is positioned correctly in the holding slot.

A beneficial way to have the invention is to have the stop block contain at least one curve. Particularly good modes of the invention include there being several curves or curved edges of the cuboid stop block, or rounded features of the cuboid stop block. The benefit of such a curve or curving is simplified insertion of the stop block in the holding socket.

When the raising apparatus is used according to the invention, the raising apparatus shall initially be used with the first spring element or initially with the second spring element in the holding slot of the stripping tool, the spring element initially in use sticks out at least partly from the holding slot of the raising apparatus in a still position. If a workpiece, work material or sheet of material is positioned over the raising apparatus and is then punched or stripped, the workpiece, work material or the sheet of material shall be squeezed by a pressure element, whereby also the spring element sticking out from the tool is squeezed from the still position into a punching position. Finally, a punch shall be made from the work material using typical shapes. As soon as the spring rate of the spring element sticking out is sufficient to lift the punching part or stripping part or sheet of material, work material or workpiece punched out, the raising apparatus turns from the punching position back to the still position, whereby the punching or stripping part, or sheet of material, work material or workpiece is lifted.

DESCRIPTION OF THE DRAWINGS

In the following the invention is explained in more detail using schematic illustrations, which show.

DESCRIPTION OF PREFERRED EXAMPLES

Figure 1:
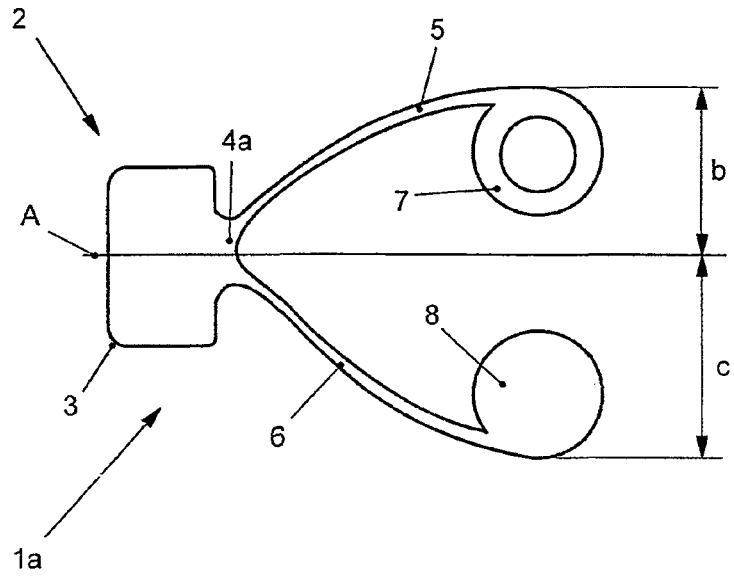
FIG. 1 is a side view of an invented raising apparatus with a stop block and two spring elements.

FIG. 1 shows a side view of a typical raising apparatus 1*a*. On a stop block 2 with rounded edges and corners 3 there are, over an aliform shape 4*a*, arranged a first spring element 5 and a second spring element 6. The first spring element 5 has a greater spring rate than the second spring element 6. The first spring element 5 is marked by a ring 7, whereas the second spring element 6 is marked by a disc 8. Regarding an axis A, which divides stop block 2 into two parts of the same size, the first spring element 5 has a maximum distance b, which is smaller than the maximum distance c of the second spring element 6 from axis A.

Figure 2:
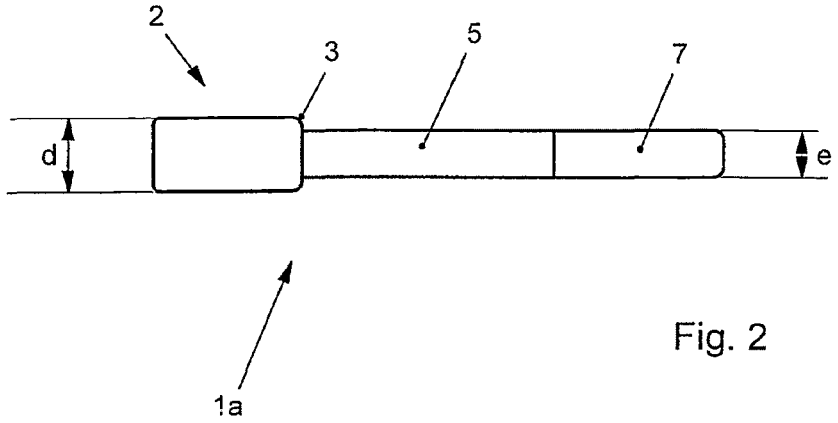
FIG. 2 is a top view of the raising apparatus of FIG. 1.

FIG. 2 shows a top view of the raising apparatus 1 shown in FIG. 1 with the stop block 2, its rounded edges 3 and its distinguishing ring 7. The thickness d of stop block 2 is greater than the width e of the first spring element 5.

Figure 3:
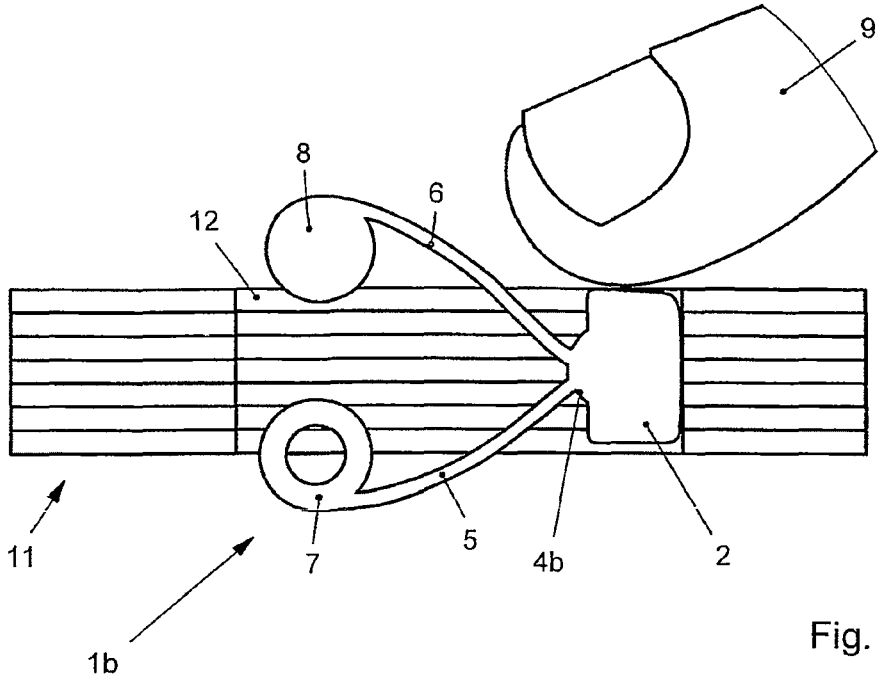
FIG. 3 shows an invented raising apparatus being pushed by a user into the holding slot of a tool.

FIG. 3 shows a second preferred example of an embodiment of the invention, namely the raising apparatus 1*b* with a stop block 2, which possesses a half spherical shape 4*b*. A first spring element 5 and a second spring element 6 are connected through this half-spherical shape C with stop block 2. A ring 7 is applied on the first spring element 5 to mark it, wherein a disc 8 is used to mark the second spring element 6. A user (mostly not shown) presses stop block 2 with his fingertip 9, whereby the whole raising apparatus 1*b* is inserted into holding slot 12 of a tool 11. The raising apparatus 1*b* is in its still position in FIG. 3.

Figure 4:
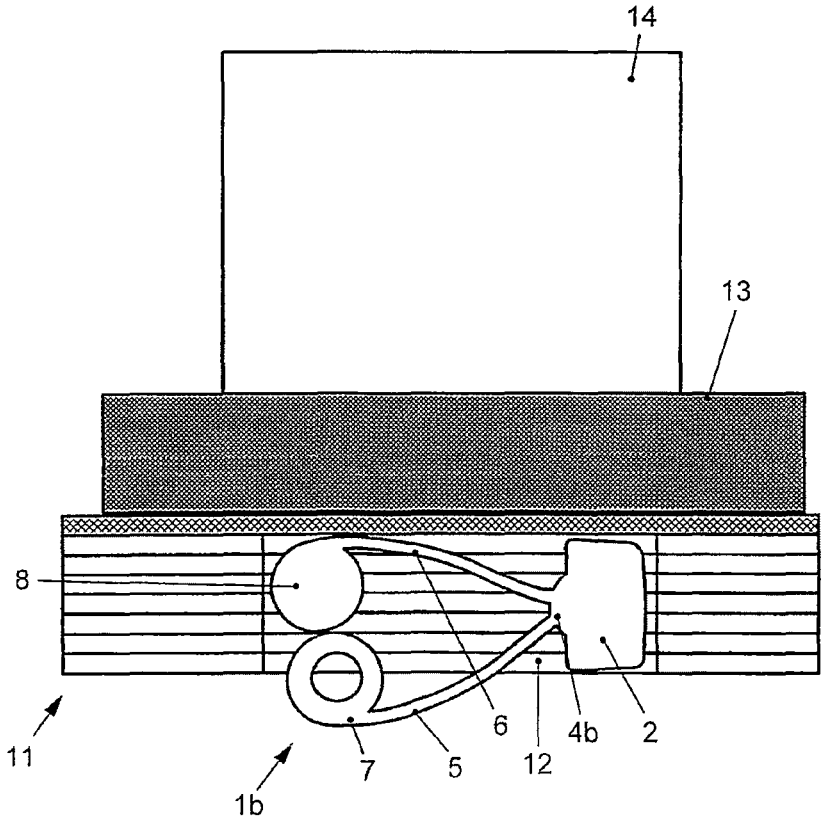
FIG. 4 shows the raising apparatus of FIG. 3 in the holding slot of the tool, wherein a work material is being pressed down upon with the help of a pressure element.

FIG. 4 shows the raising apparatus 1*b* already illustrated in FIG. 3, with the stop block 2, the half spherical shape 4*b*, the first spring element 5 with ring 7, and the second spring element 6 with disc 8. The raising apparatus 1*b* is inserted in the holding slot 12 of a tool 11. A pressure element 14 presses work material 13 on the tool 11 and the raising apparatus 1*b* positioned in the holding slot 12 of the tool 11. In this way the second spring element 6 is squeezed in the holding slot 12. The raising apparatus 1*b* is in its punching position in FIG. 4.

Figure 5:
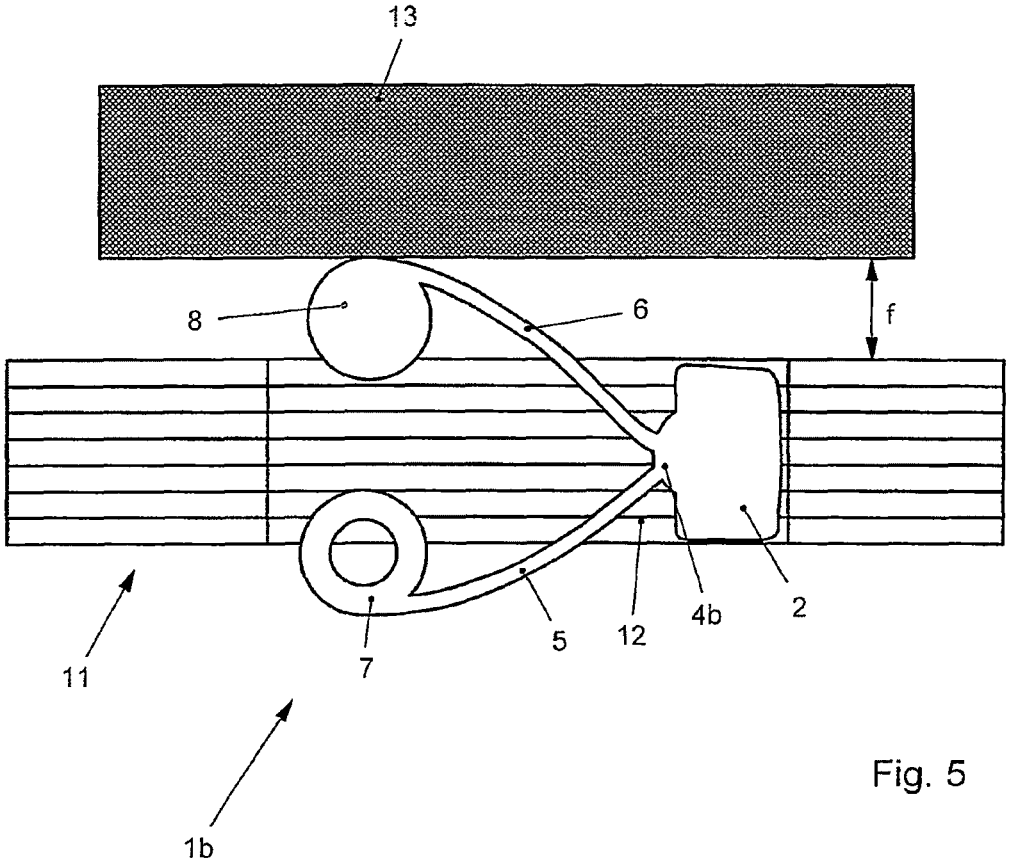
FIG. 5 shows the raising apparatus of FIG. 3 in the holding slot of the tool in a still position, wherein the raising apparatus pushes the work material away from the holding slot.

FIG. 5 also shows the raising apparatus 1*b* in holding slot 12 of a tool as well as working material 13. The working material 13 is not, however, pressed on the tool 11 with holding slot 12 and raising apparatus 1*b* in FIG. 5, whereby the work material 13 is pushed away and upwards from tool 11 and the holding slot 12 by the second spring element 6 marked with disc 8. The raising apparatus 1*b* is in its still position in FIG. 5. If the work material 13 is now transported over the tool 11, there is no risk of the work material 13 becoming entangled with the tool 11, since the raising apparatus 1*b* ensures a minimum distance f between the work material 13 and the tool 11.

The invention is not limited to the examples presented above. Rather, the scope of protection is defined by the claims presented below.

The invention claimed is:

1. A tool for lifting at least one item selected from the group consisting of a sheet of paper, a sheet of cardboard, a punched piece of paper and a punched piece of cardboard, the tool comprising:

a holding slot; and a raising apparatus configured to be in the holding slot, the raising apparatus comprising a one-piece plastic article comprising each of a block, a first spring element connected to the block, the first spring element having a first spring rate, and a second spring element connected to the block, the second spring element having a second spring rate that is different from the first spring rate.

2. The tool according to claim 1, wherein the first spring element extends outwardly from the holding slot.

3. The tool according to claim 2, wherein the block is positioned in the holding slot.

4. The tool according to claim 1, wherein the tool is configured so that:

when the block is in a first orientation in the holding slot, the first spring extends outwardly from the holding slot and is configured to lift the at least one item selected from the group consisting of the sheet of paper, the sheet of cardboard, the punched piece of paper and the punched piece of cardboard; and when the block is in a second orientation in the holding slot, the second spring extends outwardly from the holding slot and is configured to lift the at least one item selected from the group consisting of the sheet of paper, the sheet of cardboard, the punched piece of paper and the punched piece of cardboard, wherein the first and second orientations are different from one another.

5. The tool according to claim 1, wherein the first spring element and the second spring element respectively include marks for use in differentiating between the first and second spring elements.

6. The tool according to claim 1, wherein the one-piece plastic article includes a furcation at which both the first spring element and the second spring element are connected with the block.

7. The tool according to claim 6, wherein the furcation comprises a concave surface extending between the first and second spring elements.

8. The tool according to claim 6, further comprising:

a first convex surface extending between the first spring element and the block; and a second convex surface extending between the second spring element and the block.

9. The tool according to claim 1, wherein a thickness of the block is greater than a width of the holding slot.

10. The tool according to claim 9, wherein a width of the first spring element and a width of the second spring element are both smaller than the width of the holding slot, so that the first spring element and the second spring element can be inserted into the holding slot.

11. The tool according to claim 9, wherein:

the holding slot comprises a holding socket; and a thickness of the block is smaller than a width of the holding socket of the holding slot, so that the block can be inserted in the holding socket.

12. The tool according to claim 11, wherein the block has at least one rounded edge or corner configured for facilitating insertion of the block into the holding socket.

13. The tool according to claim 1, wherein at least one of the first and second spring elements includes a mark for differentiating the at least one of the first and second spring elements from the other of the first and second spring elements.

14. The tool according to claim 1, wherein:

the block includes a curved portion;

the first spring element is connected to the curved portion of the block; and the second spring element is connected to the curved portion of the block.

15. The tool according to claim 1, wherein a width of the first spring element and a width of the second spring element are both smaller than a width of the holding slot, so that the first spring element and the second spring element can be inserted into the holding slot.

16. A method of using the tool of claim 1, the method comprising:

positioning the raising apparatus in the holding slot so that either the first spring element or the second spring element is initially set in the holding slot, and the spring element not set first is at least partly protruding out from the holding slot in a still position of the raising apparatus;

pressing down on the spring element not set first so that the spring element not set first is moved at least farther into the holding slot so that the raising apparatus is in a punching position, comprising pressing down on the spring element not set first with at least one material selected from the group consisting of a work material and one or more sheets of material;

punching out or stripping a punching part or stripping part from the at least one material selected from the group consisting of the work material and the one or more of the sheets of material;

releasing the at least one material selected from the group consisting of the work material and the one or more of the sheets of material; and the raising apparatus returning from the punching position to the still position, so that at least one element is lifted, wherein the at least one element is selected from the group consisting of the work material, the one or more sheets of material, the punching part and the stripping part.

17. A method of using the tool of claim 1, comprising:

positioning the raising apparatus in the holding slot so that the first spring element of the raising apparatus is not protruding out of an upper opening of the holding slot, and the second spring element of the raising apparatus is at least partly protruding out of the upper opening of the slot in a still position of the raising apparatus;

pressing down on the second spring element so that the second spring element is moved at least farther into the holding slot so that the raising apparatus is in a punching position, comprising pressing down on the second spring element with at least one material selected from the group consisting of a work material and one or more of sheets of material;

punching out or stripping a punching part or stripping part from the at least one material selected from the group consisting of the work material and the one or more of sheets of material;

releasing the at least one material selected from the group consisting of the work material and the one or more of sheets of material; and the raising apparatus returning from the punching position to the still position, so that at least one element is lifted, wherein the at least one element is selected from the group consisting of the work material, the one or more sheets of material, the punching part and the stripping part, wherein the first spring element has a first spring rate, and the second spring element has a second spring rate that is different from the first spring rate.

18. The method of claim 17, further comprising:

repositioning the raising apparatus in the slot so that the second spring element of the raising is not protruding out of the upper opening of the holding slot, and the first spring element of the raising apparatus is at least partly protruding out of the upper opening of the slot in a still position of the raising apparatus; and pressing down on the first spring element so that the first spring element is moved at least farther into the holding slot so that the raising apparatus is in a punching position.

* * * * *